US009042580B2

(12) United States Patent
Gao et al.

(10) Patent No.: US 9,042,580 B2
(45) Date of Patent: May 26, 2015

(54) DIAPHRAGM

(71) Applicant: Suzhou Sonavox Electronics Co., Ltd, Suzhou, Jiangsu (CN)

(72) Inventors: Peng Gao, Jiangsu (CN); Guoqiang Chai, Jiangsu (CN); Jianming Zhou, Jiangsu (CN)

(73) Assignee: Suzhou Sonavox Electronics Co., Ltd, Suzhou, Jiangsu (CN)

( * ) Notice: Subject to any disclaimer, the term of this patent is extended or adjusted under 35 U.S.C. 154(b) by 0 days.

(21) Appl. No.: 14/021,804

(22) Filed: Sep. 9, 2013

(65) Prior Publication Data

US 2014/0119577 A1 May 1, 2014

(30) Foreign Application Priority Data

Oct. 30, 2012 (CN) ..... 2012 2 05621921 U

(51) Int. Cl.
*H04R 1/00* (2006.01)
*H04R 7/26* (2006.01)

(52) U.S. Cl.
CPC .. *H04R 1/00* (2013.01); *H04R 7/26* (2013.01); *H04R 2307/025* (2013.01)

(58) Field of Classification Search
CPC ..... H04R 1/00; H04R 1/28; H04R 1/2803; H04R 7/26
USPC ..... 381/162, 353, 413; 181/157, 167, 199
See application file for complete search history.

(56) References Cited

U.S. PATENT DOCUMENTS

2013/0056296 A1 * 3/2013 Goossens et al. ..... 181/157
2013/0070953 A1 * 3/2013 Dodd et al. ..... 381/398

FOREIGN PATENT DOCUMENTS

GB 2478160 * 8/2011

* cited by examiner

*Primary Examiner* — Tuan D Nguyen
(74) *Attorney, Agent, or Firm* — Stites & Harbison PLLC; Cong Ding

(57) ABSTRACT

A diaphragm is disclosed in the invention, which comprises a one-piece diaphragm body and a plurality of mass blocks mounted on the diaphragm body. Each of the mass blocks substantially has the same radial distance from the center of the diaphragm. The mass blocks are divided into three or more arrays each of which includes one or more mass blocks. the arrays are distributed along the circumference direction of the diaphragm body, and the mass blocks in each array are distributed along the circumference direction of the diaphragm. The mass blocks are elastic and made of materials with internal damping, such as rubber, silicone or foam rubber. At least one of the mass blocks is connected to an annular roll fixed on the peripheral edge of the diaphragm body, and the mass blocks are bonded to the diaphragm body.

8 Claims, 4 Drawing Sheets

DIAPHRAGM

CROSS REFERENCE TO RELATED APPLICATIONS

This application claims priority to CN application no. CN2012205621921 filed Oct. 30, 2012 under 35 U.S.C. 119 (a).

FIELD OF THE INVENTION

The invention relates to a diaphragm.

DESCRIPTION OF THE RELATED ART

A speaker is an electro-acoustic transducer device, the diaphragm of which vibrates due to the electromagnetic effect produced from electric energy, and the vibrating diaphragm resonates with the ambient air to produce sound. The shape of the diaphragm always influences the sound effect. The diaphragm of the existing speakers generally has a truncated cone shape. when the diaphragm sounds by vibration, peaks often arise in some frequency sections, such as 2000 Hz~3000 Hz, which may create harsh or hoarse sound, therefore resulting in distortion of original sound and poor sound effect.

SUMMARY OF THE INVENTION

The technical problem to be solved by the invention is to provide a diaphragm which can effectively reduce peaks and troughs on the frequency response curve resulted from partition vibration.

One object of the present invention is to provide a diaphragm comprising a one-piece diaphragm body which is substantially cone-shaped and a plurality of mass blocks mounted on the diaphragm body, wherein each of the mass blocks substantially has the same radial distance from the center of the diaphragm.

Preferably, the plurality of mass blocks are divided into three or more arrays, each array including one or more mass blocks.

More preferably, the arrays are distributed along the circumferential direction of the diaphragm body.

Still more preferably, the mass blocks of each array are distributed along the circumferential direction of the diaphragm body.

Preferably, the mass blocks are elastic.

More preferably, the mass blocks are made of materials with internal damping.

Still more preferably, the mass blocks are made of rubber, silicone or foam rubber.

Preferably, at least one of the mass blocks is connected to an annular roll fixed on the outer periphery of the diaphragm body.

Preferably, the mass blocks are bonded to the diaphragm body.

More Preferably, the diaphragm body has a front side and a back side, wherein the mass blocks being arranged on the front side.

Due to the above technical solution, the present invention has the advantages over the prior art:

The frequency response curve is smoother, and the distortion is reduced; harsh sound arisen from peaks is eliminated in some frequency sections, thereby creating more natural and nicer sound.

DETAILED DESCRIPTION OF THE PREFERRED EMBODIMENTS

Figure 1:
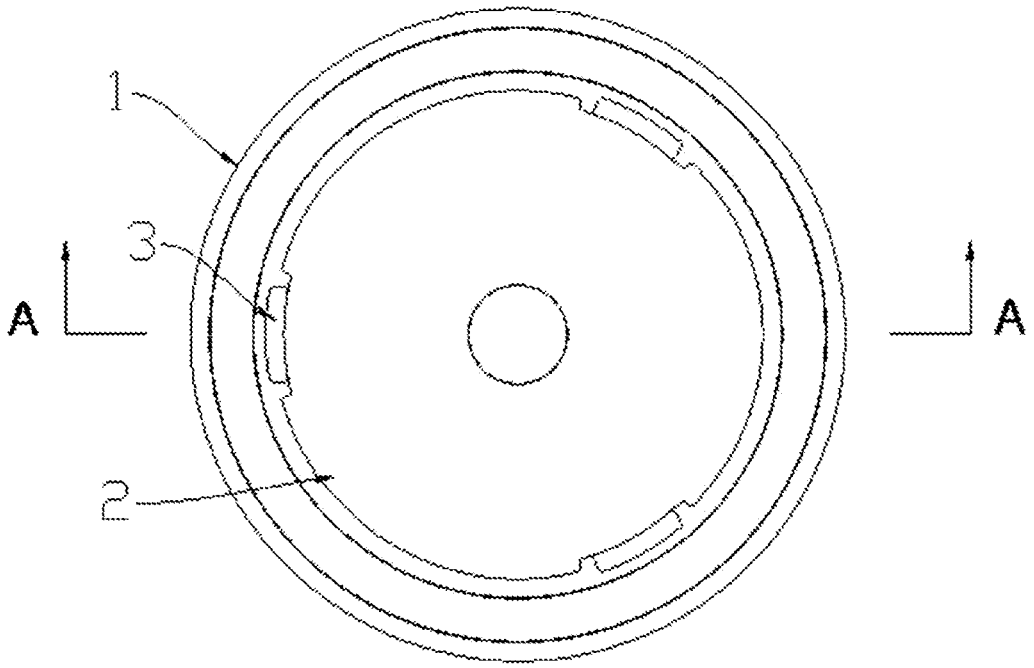
FIG. 1 is a top view of a first embodiment of the invention.
Figure 2:
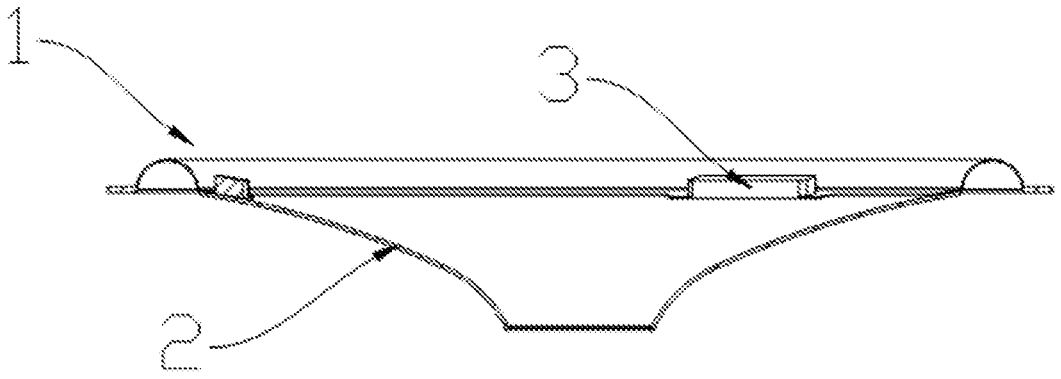
FIG. 2 is a cross-sectional view of the first embodiment along A-A direction shown in FIG. 1 according to the invention.
Figure 3:
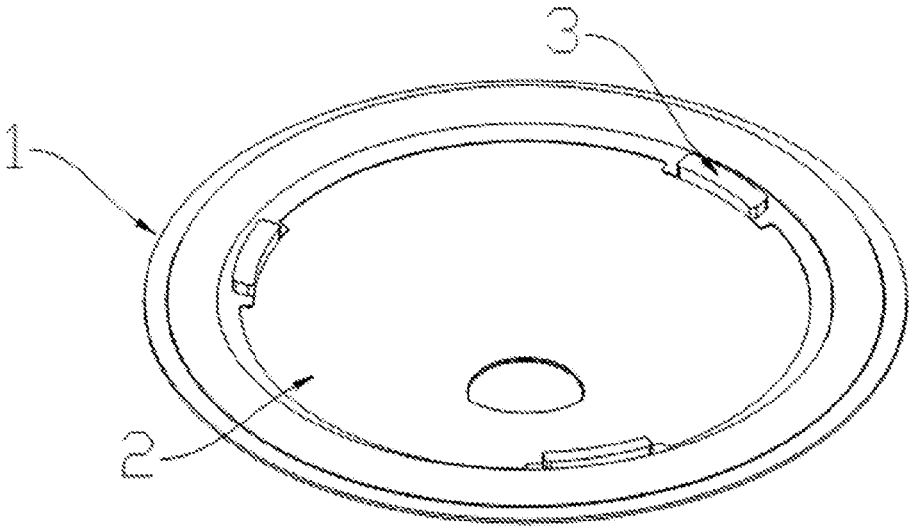
FIG. 3 is a perspective view of the first embodiment of the invention.
Figure 4:
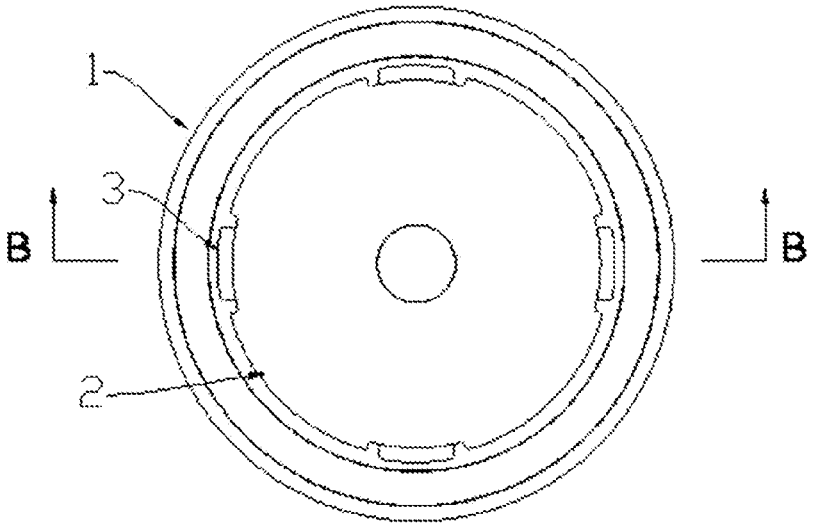
FIG. 4 is a top view of a second embodiment of the invention.
Figure 5:
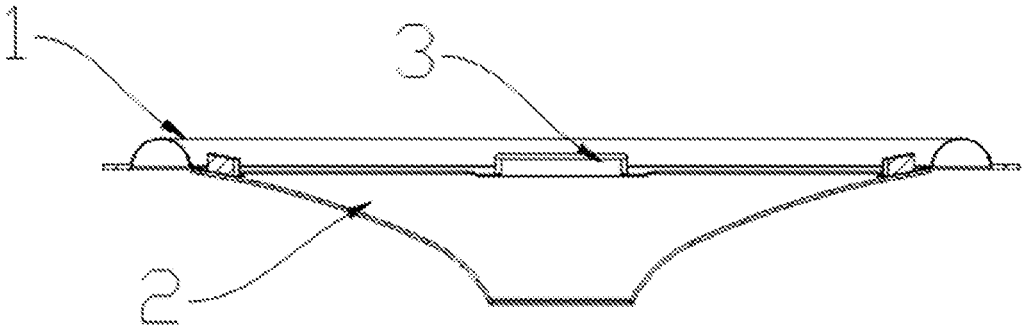
FIG. 5 is a cross-sectional view of the second embodiment along B-B direction shown in FIG. 4 according to the invention.
Figure 6:
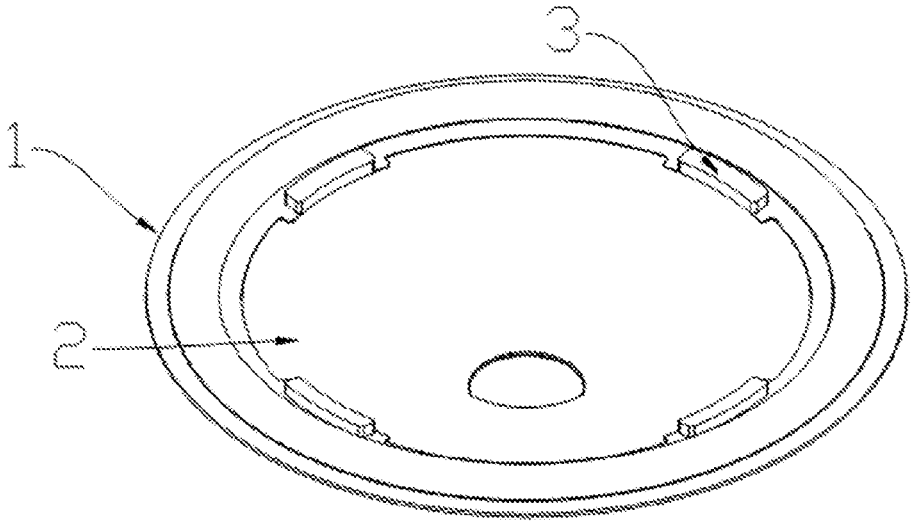
FIG. 6 is a perspective view of the second embodiment of the invention.
Figure 7:
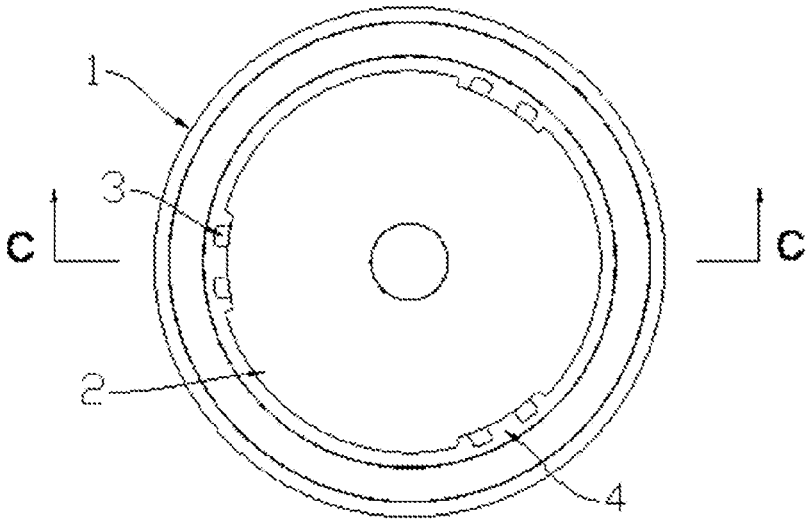
FIG. 7 is a top view of a third embodiment of the invention.
Figure 8:
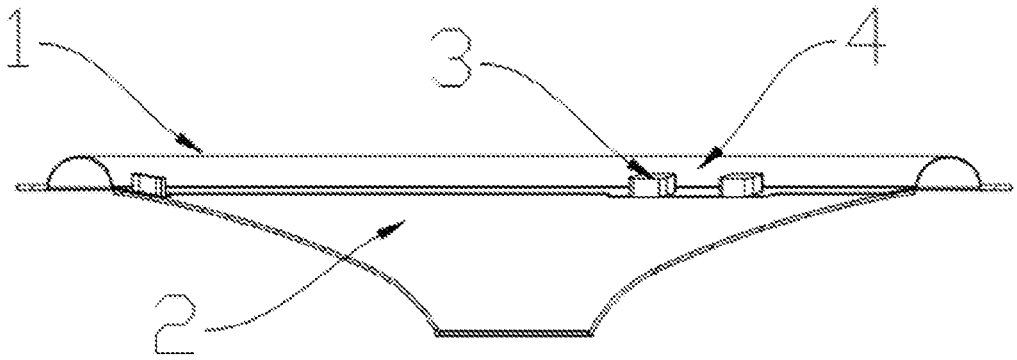
FIG. 8 is a cross-sectional view of the third embodiment along C-C direction shown in FIG. 7 according to the invention.
Figure 9:
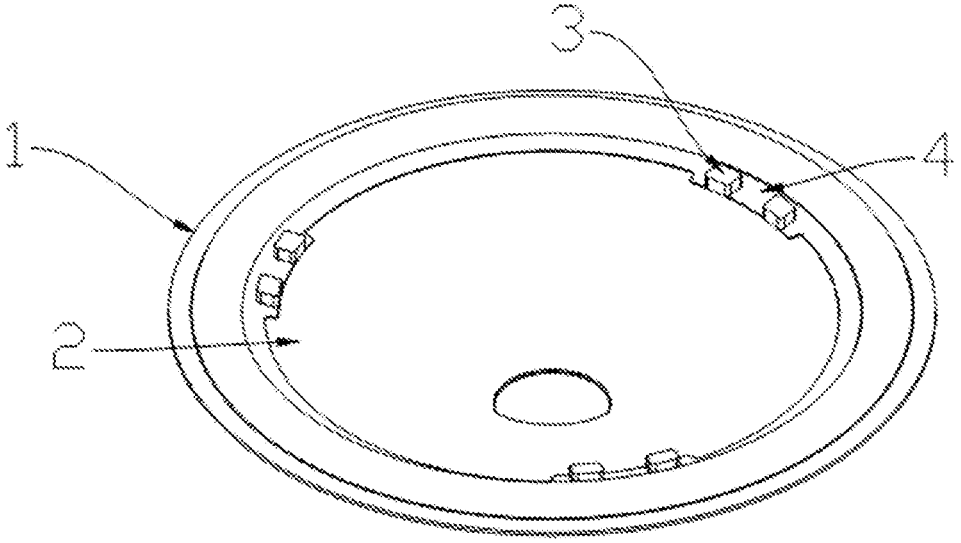
FIG. 9 is a perspective view of the third embodiment of the invention.

The diaphragm of the first embodiment of the invention is illustrated in FIGS. 1-3, which comprises a one-piece diaphragm body 2 and a plurality of mass blocks mounted on the diaphragm body 2. The diaphragm body 2 has a front side and a back side, and the mass blocks are arranged on the front side. The diaphragm body 2 substantially has a truncated cone shape, and the inside diameter of one end of the diaphragm body 2 is greater than that of the other end. The cross section of the diaphragm body 2 has a closed ring shape.

The phrases of "front side" and "back side" mentioned herein and throughout the specification are defined according to the observation habit, as the side can be seen is denominated as "front side" when the diaphragm is mounted to the loudspeaker, while the opposite side is referred to as "back side".

As shown in FIG. 1 and FIG. 3, the diaphragm is provided with three mass blocks. Specifically, the three mass blocks are disposed on the front side of the diaphragm body 2, each of the mass blocks substantially has the same radial distance from the center of the diaphragm. However, it is also conceivable that the three mass blocks are disposed on the back side of the diaphragm body, and such configuration will not be described detailedly herein for short.

Each of the mass blocks is elastic so that the distortion arisen from vibration of the mass blocks can be avoided effectively.

Each of the mass blocks is made of materials with internal damping. Such materials can be made from rubber, silicone or foam rubber or the like. The damping of the whole diaphragm is increased and the partition vibration is reduced due to such mass blocks.

Preferably, the mass blocks are bonded to the diaphragm body for vibrating with the diaphragm body as a whole.

The second embodiment of the invention is different from the first embodiment in that the diaphragm comprises four mass blocks. Each of the four mass blocks substantially has the same radial distance from the center of the diaphragm. It is noted that, the extent of protection of the invention is not limited to the quantity of the mass blocks, namely, if multiple mass blocks are provided, and each of which substantially has the same radial distance from the center of the diaphragm, then such configurations should be considered within the protecting scope of the invention.

The third embodiment of the invention is different from the first embodiment in that the diaphragm comprises three arrays. Each array comprises two mass blocks each of which substantially has the same radial distance from the center of the diaphragm. Particularly, the three arrays are distributed along the circumferential direction of the diaphragm body, and the mass blocks of each array are distributed along the circumferential direction of the diaphragm body.

It shall be appreciated that the protection scope of the invention is not limited to the quantities of the arrays and the mass blocks. That means, as long as the quantity of the arrays is greater than three, the quantity of the mass blocks of each array is greater than two and the mass blocks substantially have the same radial distance from the center of the diaphragm, then such configurations shall be considered within the protection scope of the invention.

As described above, the specific embodiments of the invention are illustrated with reference to drawings, but the invention is not limited to the aforementioned embodiments. Many variations and implements can be made within the scope of the invention by those skilled in the related art.

The invention claimed is:

1. A diaphragm, comprising a one-piece diaphragm body which is substantially cone-shaped; and a plurality of mass blocks mounted on the diaphragm body, wherein each of the mass blocks substantially has the same radial distance from the center of the diaphragm, wherein the plurality of mass blocks are divided into three or more arrays, each array including one or more mass blocks, and wherein the mass blocks of each array are distributed along the circumferential direction of the diaphragm body.

2. The diaphragm as claimed in claim 1 wherein the arrays are distributed along the circumferential direction of the diaphragm body.

3. The diaphragm as claimed in claim 1, wherein the mass blocks are elastic.

4. The diaphragm as claimed in claim 1, wherein the mass blocks are made of materials with internal damping.

5. The diaphragm as claimed in claim 1, wherein the mass blocks are made of rubber, silicon or foam rubber.

6. The diaphragm as claimed in claim 1, wherein at least one of the mass blocks is connected to an annular roll fixed on the outer periphery of the diaphragm body.

7. The diaphragm as claimed in claim 1, wherein the mass blocks are bonded to the diaphragm body.

8. The diaphragm as claimed in claim 1, wherein the diaphragm body has a front side and a back side, wherein the mass blocks being preferably arranged on the front side.

* * * * *